US007824226B1

(12) United States Patent
Yang

(10) Patent No.: US 7,824,226 B1
(45) Date of Patent: Nov. 2, 2010

(54) ELECTRICAL TERMINAL

(75) Inventor: Chih-Ling Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/636,772

(22) Filed: Dec. 13, 2009

(51) Int. Cl.
*H01R 24/00* (2006.01)

(52) U.S. Cl. ..... 439/630

(58) Field of Classification Search ..... 439/630, 439/604, 736
See application file for complete search history.

(56) References Cited

U.S. PATENT DOCUMENTS 3,742,432 A * 6/1973 Curtis et al. ..... 439/882
4,690,484 A * 9/1987 Oba et al. ..... 439/736
6,027,381 A * 2/2000 Lok ..... 439/736

* cited by examiner

*Primary Examiner*—Phuong K Dinh

(57) ABSTRACT

An electrical terminal integrated with an insulating housing by means of insert molding includes a long and narrow base plate embedded in the insulating housing, a soldering portion extended from one end of the base plate and a contact portion connected with the other end of the base plate. The base plate defines at least one fixing hole passing therethrough at a portion thereof. Portions of two opposite sides of the base plate are recessed inward to form at least one pair of opposite openings. A pair of opposite buckling tabs is extended outwardly from inmost edges of the pair of opening, slanted and bent downward. During molding, the fluent plastic material flows into the fixing hole and the openings, the buckling tabs are buckled and embedded in the insulating housing.

6 Claims, 2 Drawing Sheets

ELECTRICAL TERMINAL

BACKGROUND OF THE INVENTION

1. Field of the Invention

The present invention generally relates to a terminal, and more particularly to an electrical terminal used in a card connector.

2. The Related Art

Referring to FIG. 3, a conventional electrical terminal 3 used in a card connector (not shown) is shown. The electrical terminal 3 has a base plate 31 with a bar shape. Two opposite ends of the base plate 31 extend oppositely to form a soldering portion 32 and a contact portion 33. The electrical terminal 3 is integrated with an insulating housing (not shown) of the card connector by means of insert molding with the base plate 31 for being embedded in the insulating housing, the soldering portion 32 being exposed from one end of the insulating housing for being soldered with a printed circuit board (not shown) and the contact portion 33 being exposed from the other end of the insulating housing for contacting with a corresponding card (not shown). The electrical terminal 3 is fixed in the insulating housing only by means of the base plate 31 being embedded in the insulating housing. However, due to the card being repeatedly inserted into and drawn out from the card connector to contact with the electrical terminal 3, the electrical terminal 3 is apt to move around or flip out from the insulating housing so that the electrical connection between the card and the card connector become unstable.

SUMMARY OF THE INVENTION

An object of the present invention is to provide an electrical terminal integrated with an insulating housing by means of insert molding. The electrical terminal includes a long and narrow base plate embedded in the insulating housing, a soldering portion extended from one end of the base plate and a contact portion connected with the other end of the base plate. The base plate defines at least one fixing hole passing therethrough at a portion thereof. Portions of two opposite sides of the base plate are recessed inward to form at least one pair of opposite openings. A pair of opposite buckling tabs is extended outwardly from inmost edges of the at least one pair of opening, slanted and bent downward. During molding, the fluent plastic material flows into the fixing hole and the openings, the buckling tabs are buckled and embedded in the insulating housing so as to form a firm connection between the electrical terminal and the insulating housing.

As described above, the electrical terminal utilizes the fixing hole, the openings and the buckling tabs of the electrical terminal for forming a firm connection between the electrical terminal and the insulating housing by means of making the fluent plastic material flow into the fixing hole and the openings, and the buckling tabs being buckled and embedded in the insulating housing during molding.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
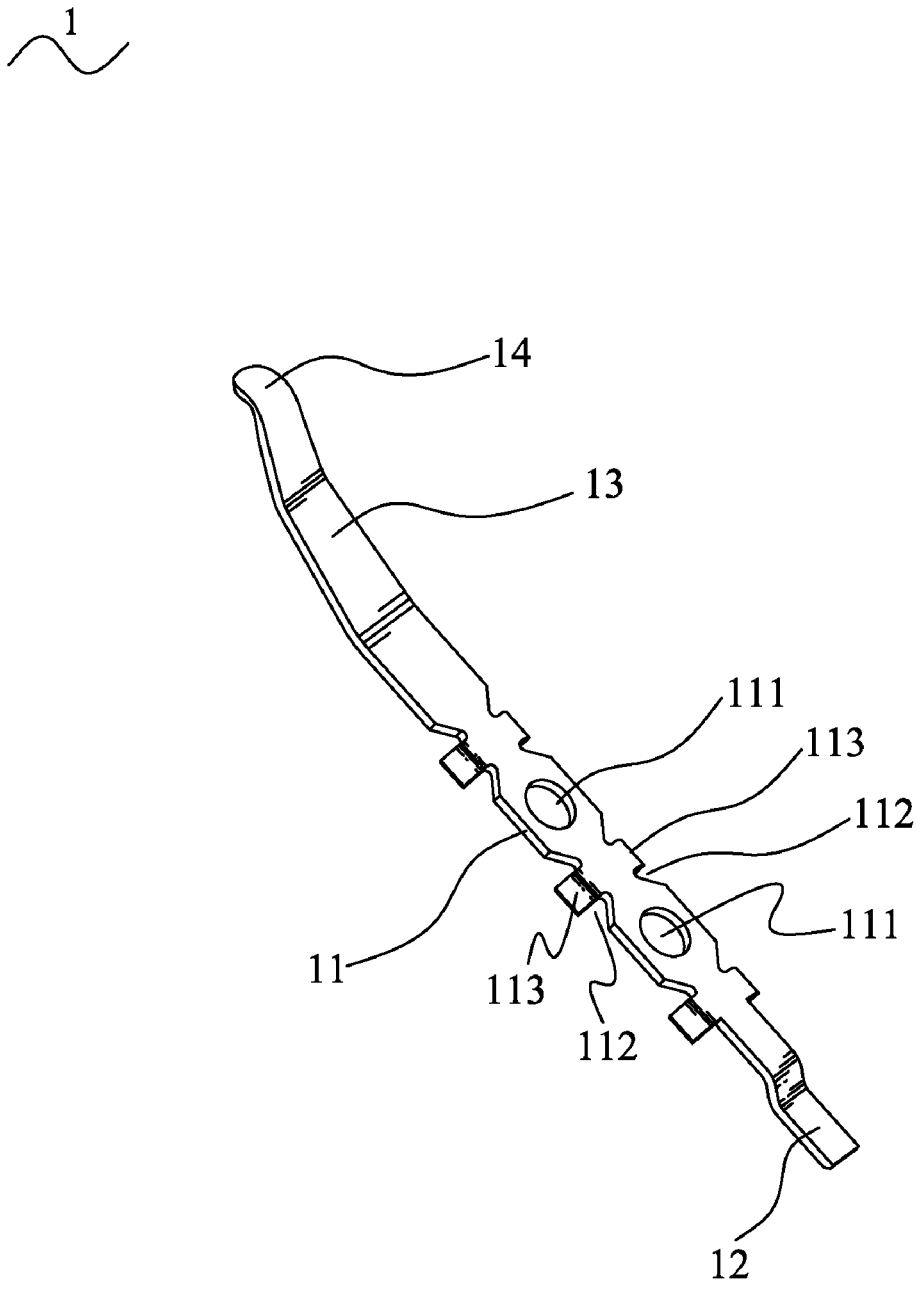
FIG. 1 is a perspective view of an electrical terminal in accordance with the present invention.
Figure 2:
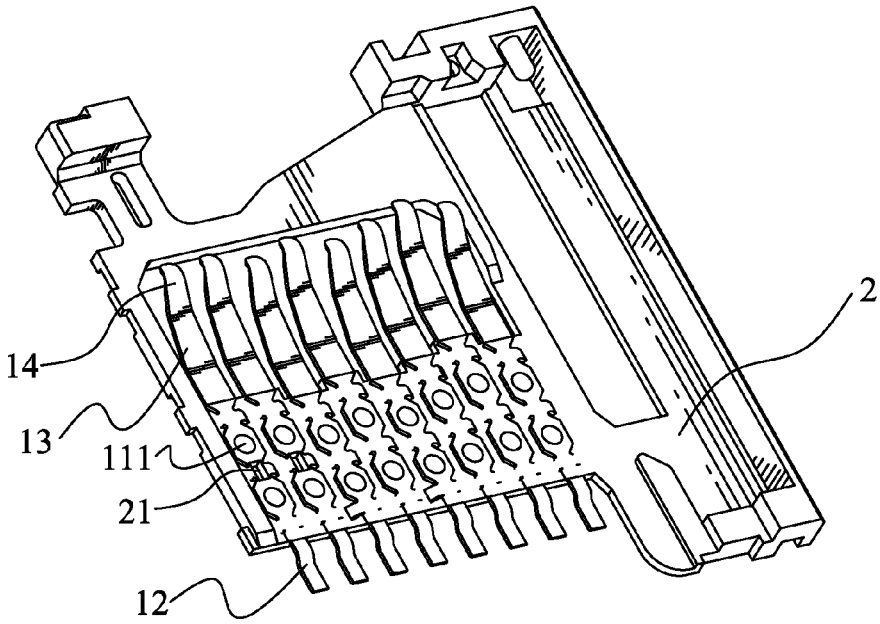
FIG. 2 is a perspective view of an assembly of an insulating housing and a plurality of electrical terminals of FIG. 1.
Figure 3:
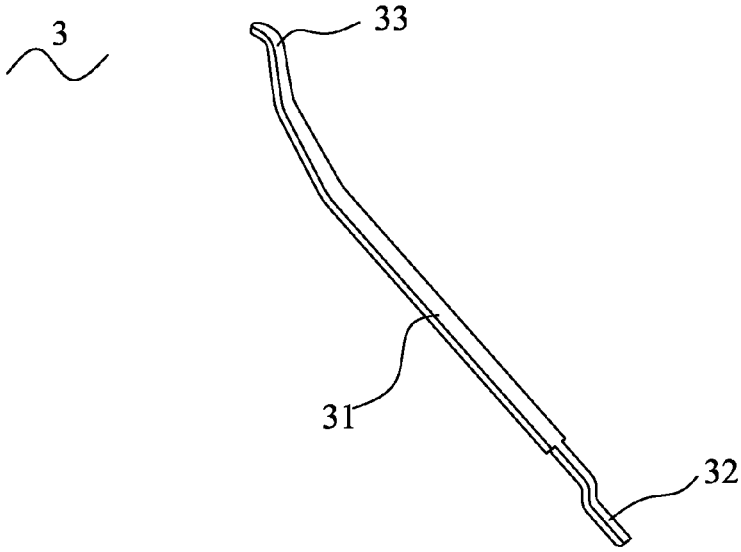
FIG. 3 (Prior Art)
FIG. 3 is a perspective view of an electrical terminal according to a prior art.

Referring to FIG. 1 and FIG. 2, an electrical terminal 1 in accordance with the present invention is shown. The electrical terminal 1 is used in a card connector and integrated with an insulating housing 2 of the card connector.

Referring to FIG. 1, the electrical terminal 1 has a long and narrow base plate 11. A middle of one end of the base plate 11 is bent perpendicularly and then extended along an extending direction of the base plate 11 to form a soldering portion 12. The other end of the base plate 11 extends towards a direction opposite to the soldering portion 12 to form an elastic portion 13. A free end of the elastic portion 13 further extends obliquely to form a contact portion 14 with a curved shape. The contact portion 14 is tapered gradually from a root to a distal end thereof. A middle of the base plate 11 defines a pair of circular fixing holes 111 passing therethrough and arranged at regular intervals along the extending direction of the base plate 11. Two opposite side edges of the base plate 11 are recessed inward to form pairs of opposite openings 112 arranged at regular intervals along the extending direction of the base plate 11 and located symmetrically at two opposite sides of the base plate 11. Each of the openings 112 is trapezoid-shaped with an inmost edge thereof as a relatively shorter base. The fixing holes 111 and the pairs of opposite openings 112 are alternately defined at the base plate 11. A pair of opposite buckling tabs 113 is extended outwardly from the inmost edges of each pair of the opposite openings 112 and then bent downward in a slanted way so that the buckling tabs 113 is lower than the adjacent upper surface of the base plate 11.

Referring to FIGS. 1-2, the insulating housing 2 is of a substantial rectangular shape. The insulating housing 2 defines a plurality of terminal grooves 21 for receiving the corresponding electrical terminals 1 therein. The electrical terminals 1 are disposed in the corresponding terminal grooves 21 and integrated with the insulating housing 2 by means of insert molding. Therefore, the base plate 11 of each of the electrical terminals 1 is embedded in the insulating housing 2, the elastic portion 13 and the contact portion 14 are exposed out from one end of the insulating housing 2 for contacting a corresponding card (not shown), and the soldering portion 12 is exposed out from the other end of the insulating housing 2 for being soldered with a printed circuit board (not shown).

The method for integrating the electrical terminal 1 with the insulating housing 2 includes following steps: firstly, fix the electrical terminal 1 in a mold (not shown) including an upper mold and a lower mold mated with the lower mold; secondly, inject fluent plastic material into a molding cavity formed between the upper and the lower molds to form the insulating housing 2; and finally take out the assembly of the insulating housing 2 and the electrical terminal 1 from the molding cavity when the mold is opened. During molding, the fluent plastic material flows into the fixing holes 111 and the openings 112 so as to make the fixing holes 111 and the openings 112 be filled with the fluent plastic material and then the fluent plastic material overflows the base plate 11 to make the base plate 11 be surrounded by the fluent plastic material. The buckling tabs 113 are buckled and embedded in the insulating housing 2 by means of making the fluent plastic material surround the buckling tabs 113. Therefore, this enhances the retention of the electrical terminal 1 in the insulating housing 2 so as to form a firm connection between the electrical terminal 1 and the insulating housing 2.

As describe above, the electrical terminal 1 utilizes the fixing holes 111, the openings 112 and the buckling tabs 113 of the electrical terminal 1 for making the connection between the electrical terminal 1 and the insulating housing 2 firm by means of making the fluent plastic material flow into the fixing holes 111 and the openings 112, and the buckling tabs 113 being buckled and embedded in the insulating housing 2 during molding. Therefore, an electrical connection between the card and the card connector is stable.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical terminal integrated with an insulating housing by means of insert molding, comprising:

a base plate embedded in the insulating housing, the base plate defining at least one fixing hole passing therethrough at a portion thereof, portions of two opposite sides of the base plate being recessed inward to form at least one pair of opposite openings, a pair of opposite buckling tabs being extended outwardly from inmost edges of the at least one pair of opening, slanted and bent downward;

a soldering portion being extended from one end of the base plate; and a contact portion being connected with the other end of the base plate, wherein during molding, a fluent plastic material flows into the fixing hole and the openings, the buckling tabs are buckled and embedded in the insulating housing so as to form a firm connection between the electrical terminal and the insulating housing.

2. The electrical terminal as claimed in claim 1, wherein the opening is of a trapezoid shape with the inmost edge thereof as a relatively shorter base.

3. The electrical terminal as claimed in claim 1, wherein the at least one fixing hole and the at least one pair of openings are alternately defined at the base plate.

4. The electrical terminal as claimed in claim 1, wherein the contact portion and the soldering portion are located in two opposite sides of the base plate for being exposed from two opposite sides of the insulating housing.

5. The electrical terminal as claimed in claim 4, wherein the other end of the base plate extends towards a direction opposite to the soldering portion to form an elastic portion, a free end of the elastic portion further extends obliquely to form the contact portion with a curved shape.

6. The electrical terminal as claimed in claim 5, wherein the contact portion is tapered gradually from a root to a distal end thereof.

* * * * *